US011175630B2

(12) United States Patent
Winkler et al.

(10) Patent No.: US 11,175,630 B2
(45) Date of Patent: Nov. 16, 2021

(54) ANTI SHOCK PROTECTION FOR A RESONATOR MECHANISM WITH ROTARY FLEXURE BEARING

(71) Applicant: ETA SA Manufacture Horlogere Suisse, Grenchen (CH)

(72) Inventors: Pascal Winkler, St-Blaise (CH); Jean-Luc Helfer, Le Landeron (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 423 days.

(21) Appl. No.: 16/392,057

(22) Filed: Apr. 23, 2019

(65) Prior Publication Data

US 2019/0324401 A1 Oct. 24, 2019

(30) Foreign Application Priority Data

Apr. 23, 2018 (EP) ..... 18168765

(51) Int. Cl.
*G04B 31/02* (2006.01)
*G04B 17/04* (2006.01)
(Continued)

(52) U.S. Cl.
CPC ..... *G04B 31/02* (2013.01); *G04B 17/04* (2013.01); *G04B 17/28* (2013.01); *G04C 3/04* (2013.01)

(58) Field of Classification Search
CPC ..... G04B 31/00; G04B 31/02; G04B 43/00; G04B 43/002; G04B 17/04; G04B 17/045; G04B 17/10; G04B 17/28; G04B 17/30
See application file for complete search history.

(56) References Cited

U.S. PATENT DOCUMENTS 3,352,000 A * 11/1967 Altenburger ..... G04C 3/102 29/896.2
3,528,308 A * 9/1970 Favre ..... G04C 3/107 74/142
(Continued)

FOREIGN PATENT DOCUMENTS

CN 101620406 A 1/2010
CN 104730898 A 6/2015
(Continued)

OTHER PUBLICATIONS

Combined Chinese Office Action and Search Report dated Sep. 2, 2020 in Chinese Patent Application No. 201910328567.4 (with Translation of Category of Cited Documents), citing documents AO-AR therein, 6 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece resonator mechanism including a structure carrying, via a flexible suspension system, an anchor unit to which is suspended an inertia element oscillating with a first rotational degree of freedom RZ, under the action of return forces exerted by a flexure pivot including first elastic strips each fixed to the inertia element and to the anchor unit, the flexible suspension system being arranged to allow the anchor unit some mobility in every degree of freedom except the first rotational degree of freedom RZ wherein only the inertia element can move to avoid any disturbance to its oscillation, and the stiffness of the suspension system in the first rotational degree of freedom RZ is very considerably higher than the stiffness of the flexure pivot in this same rotational degree of freedom RZ.

22 Claims, 4 Drawing Sheets

(51) Int. Cl.
*G04B 17/28* (2006.01)
*G04C 3/04* (2006.01)

(56) References Cited

U.S. PATENT DOCUMENTS

| | | | | |
|---|---|---|---|---|
| 10,216,149 | B2 * | 2/2019 | Winkler | G04B 17/045 |
| 2016/0179058 | A1 | 6/2016 | Born et al. | |
| 2016/0223989 | A1 | 8/2016 | Winkler et al. | |
| 2016/0327909 | A1 * | 11/2016 | Henein | G04B 17/045 |

FOREIGN PATENT DOCUMENTS

| | | | |
|---|---|---|---|
| CN | 107710081 | A | 2/2018 |
| EP | 2 894 521 | A1 | 7/2015 |
| EP | 3 035 127 | A1 | 6/2016 |
| EP | 3 054 357 | A1 | 8/2016 |

OTHER PUBLICATIONS

European Search Report dated Nov. 14, 2018 in European Application 18168765.8 filed on Apr. 23, 2018 (with English Translation of Categories of Cited Documents).

* cited by examiner

ANTI SHOCK PROTECTION FOR A RESONATOR MECHANISM WITH ROTARY FLEXURE BEARING

CROSS-REFERENCE TO RELATED APPLICATION

This application claims priority to European Patent Application No. 18168765.8 filed on Apr. 23, 2018, the entire disclosure of which is hereby incorporated herein by reference.

FIELD OF THE INVENTION

The invention concerns a timepiece resonator mechanism comprising a structure and an anchor unit to which is suspended at least one inertia element arranged to oscillate with a first rotational degree of freedom RZ about a pivot axis extending in a first direction Z, said inertia element being subjected to return forces exerted by a flexure pivot comprising a plurality of first elastic strips, each fixed, at a first end to said anchor unit, and at a second end to said inertia element, each said elastic strip being deformable essentially in a plane XY perpendicular to said first direction Z, said resonator mechanism comprising axial stop means including at least a first axial stop and/or a second axial stop to limit the translational travel of said inertia element at least in said first direction Z, said axial stop means being arranged to abuttingly engage with said inertia element in order to protect said first strips at least against axial impacts in said first direction Z.

The invention also concerns a timepiece oscillator including at least one such resonator mechanism.

The invention also concerns a timepiece movement including at least one such oscillator and/or one such resonator mechanism.

The invention also concerns a watch including such a timepiece movement and/or such an oscillator and/or such a resonator mechanism.

The invention concerns the field of timepiece resonators and more particularly those that include elastic strips acting as return means for operation of the oscillator.

BACKGROUND OF THE INVENTION

Shock resistance is a difficult issue for most timepiece oscillators, and in particular for crossed strip resonators. Indeed, during out-of-plane impact, the stress experienced by the strips rapidly reaches very high values, which, accordingly, reduces the travel that the part can make before yielding.

Shock absorbers for timepieces are available in many variants. However, their function, essentially, is to protect the fragile pivots of the arbor, and not the elastic elements, such as, conventionally, the balance spring.

European Patent Application No. EPEP3054357A1 in the name of ETA Manufacture Horlogère Suisse discloses a timepiece oscillator including a structure and distinct primary resonators, which are temporally and geometrically offset, each comprising a weight returned towards the structure by an elastic return means. This oscillator includes coupling means for the interaction between the primary resonators, including driving means for driving motion of a wheel set which includes driving and guiding means arranged to drive and guide a control means articulated to transmission means, each articulated, at a distance from the control means, to a weight of a primary resonator. The primary resonators and wheel set are arranged such that the articulation axes of any two primary resonators and the articulation axis of the control means are never coplanar.

European Patent Application No. EP3035127A1 in the name of SWATCH GROUP RESEARCH & DEVELOPMENT Ltd discloses a timepiece oscillator including a resonator formed by a tuning fork which includes at least two oscillating moving parts, fixed to a connection element by flexible elements whose geometry determines a virtual pivot axis of determined position with respect to a plate, and about which oscillates the respective moving part, whose centre of mass coincides in the rest position with the respective virtual pivot axis.

For at least one moving part, the flexible elements are formed of crossed elastic strips at a distance from each other in two parallel planes, and whose directions, in projection onto one of the parallel planes, intersect at said virtual pivot axis of the moving part.

New mechanism structures make it possible to maximise resonator quality factor, through the use of a flexure bearing with the use of a lever escapement having a very small angle of lift, according to Swiss Patent Application No CH713150 in the name of ETA Manufacture Horlogère Suisse and derivative patents, whose teaching can be directly used in the present invention, and whose resonator can be further improved as regards its shock sensitivity, in certain particular directions. It is thus a matter of protecting the strips from breakage in the event of impact. It is clear that the anti shock systems so far proposed for resonators with flexure bearings only protect the strips from impact in certain directions, but not in all directions, or that they have the drawback of letting the point of attachment of the flexure pivot move slightly during its oscillatory rotation, which should be avoided as far as possible.

SUMMARY OF THE INVENTION

It is thus a matter of protecting the strips from breakage in the event of impact. In other words, to make a good rotating resonator with a flexure bearing, the latter, which forms a flexure pivot and defines a virtual pivot axis, must be both very flexible for oscillatory rotation in a first rotational degree of freedom RZ, but it must be very stiff in the other degrees of freedom (X, Y, Z, RX, RY) in order to avoid undesired motions of the centre of mass of the resonator. Indeed, such undesired motions can cause errors of run, if the orientation of the resonator changes in the field of gravity (referred to as 'error in the positions'). Very stiff suspension of the attachment point of the pivot is necessary according to the degree of freedom of the oscillation, to avoid disturbing the isochronism of the resonator, and to avoid dissipating energy in motions due to reaction forces.

The invention proposes to limit the out-of-plane displacements of the strips of a strip resonator, and thus to ensure improved resistance of the system, To this end, the invention concerns a strip resonator mechanism according to claim 1.

The invention also concerns a timepiece oscillator including at least one such resonator mechanism.

The invention also concerns a timepiece movement including at least one such resonator mechanism.

The invention further concerns a watch including such a timepiece movement and/or a such a resonator mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
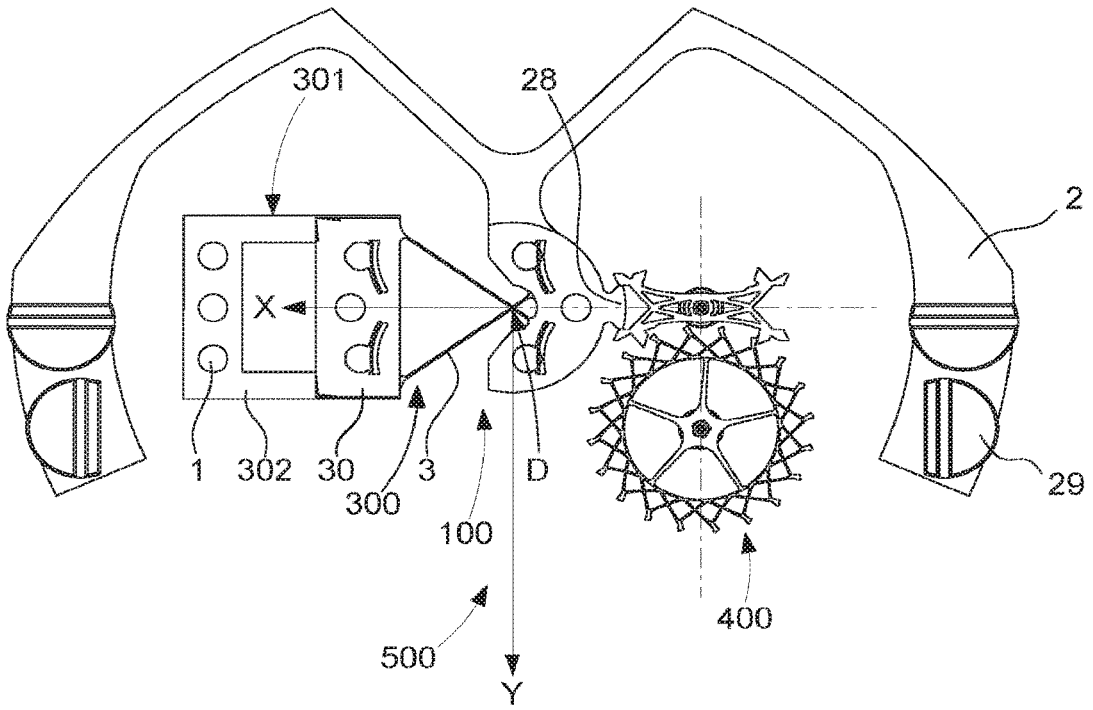
FIG. 1 represents a schematic plan view of a resonator mechanism with elastic strips, comprising an inertia weight suspended to an anchor unit by a flexure pivot comprising two parallel levels of elastic strips, the directions in which these strips extend intersect, in projection, on a virtual pivot axis of this inertia element, in accordance with Swiss Patent Application No CH713150 in the name of ETA Manufacture Horlogère Suisse, and whose teaching can be used for the present invention.
Figure 2:
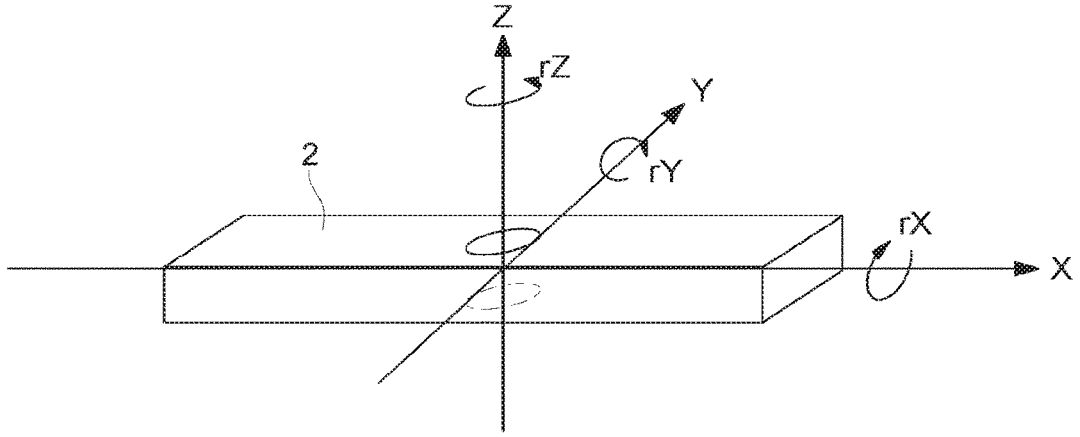
FIG. 2 shows a schematic, perspective view of the various degrees of freedom of the inertia weight comprised in the resonator mechanism of FIG. 1.

The idea here, is to suspend a flexure pivot 200 of a timepiece resonator 100 to a suspension system that is flexible in 5 degrees of freedom but stiff in the only degree of freedom in which said pivot works and which is that of the oscillation of at least one inertia element 2, comprised in this resonator 100. The 5 flexible degrees of freedom, which correspond to the directions in which impacts could damage the pivot strips, have a travel limited by stops, against which the inertia element of the resonator comes to rest in the event of impact.

The present description more particularly illustrates the case of a mechanical watch movement, provided with a resonator 100 with a rotary flexure bearing, which forms a flexure pivot 200 defining a virtual pivot axis D in a first direction Z. This flexure pivot 200 is, in this particular case, made from flexible strips 3, which, according to the invention, are protected from breakage in the event of impact by an anti shock system comprising a flexible suspension system, which connects the anchor point of flexure pivot 200 to a structure 1, especially the plate of the movement, in combination with a set of stops which are arranged to limit the travel of the inertia element of the resonator via bearing surfaces.

According to the invention, this anti shock system is flexible in 5 degrees of freedom and stiff in the degree of freedom corresponding to oscillation of the resonator, which is first direction Z here. The stops allow inertia element 3 to move freely in the oscillatory degree of freedom of the resonator but limit its travel in the other 5 degrees of freedom.

The invention therefore concerns a timepiece resonator mechanism 100, comprising a structure 1 and an anchor unit 30, to which at least one inertia element 2 is suspended. Each inertia element 2 is arranged to oscillate in a first rotational degree of freedom RZ about a pivot axis D extending in a first direction Z. The centre of inertia resulting from all the inertia elements 2 is aligned on pivot axis D.

The invention is illustrated in the Figures, in non-limiting manner, with a single inertia element 2; those skilled in the art will know how to apply the teaching of the present Application to the case of a plurality of inertia elements, particularly superposed elements.

Inertia element 2 is subjected to return forces exerted by a flexure pivot 200 comprising a plurality of first elastic strips 3, each fixed, at a first end to anchor unit 30, and at a second end to inertia element 2. Each elastic strip 3 is deformable essentially in a plane XY perpendicular to first direction Z.

Resonator mechanism 100 includes axial stop means, which include at least a first axial stop 7 and/or a second axial stop 8 to limit the translational travel of inertia element 2, at least in first direction Z. These axial stop means are arranged to abuttingly engage with inertia element 2 in order to protect first strips 3, at least against axial impacts in first direction Z.

According to the invention, anchor unit 30 is suspended to structure 1 by a flexible suspension system 300, which is arranged to allow anchor unit 30 mobility in five flexible degrees of freedom of the suspension system.

These five flexible degrees of freedom of the suspension system are:

a first translational degree of freedom in first direction Z;

a second translational degree of freedom in a second direction X orthogonal to first direction Z;

a third translational degree of freedom in a third direction Y orthogonal to the second direction X and to first direction Z;

a second rotational degree of freedom RX about an axis extending in second direction X;

and a third rotational degree of freedom RY about an axis extending in third direction Y.

In short, anchor unit 30 is suspended to structure 1 by flexible suspension system 300, in a manner that allows it some mobility in all degrees of freedom other than first rotational degree of freedom RZ in which only inertia element 2 must be able to move, to avoid any disturbance to its oscillation, which is essential for the invention. Anchor unit 30 carries flexure pivot 200 to which inertia element 2 is suspended, and the stiffness of suspension system 300 in first rotational degree of freedom RZ must be very considerably higher than the stiffness of flexure pivot 200 in this same rotational degree of freedom RZ.

In each of the other five flexible degrees of freedom of the suspension system listed above, the condition is reversed: the stiffness of the suspension system in each of these five flexible degrees of freedom of the suspension system must be much lower than that of flexure pivot 200 in the same degree of freedom considered.

Stiffness is defined here, for a degree of freedom 'i' as:

in rotation $C_i$=dMoment/dAngle;

in translation $K_i$=dForce/dDisplacement.

The matrix below sets out the relative conditions between the stiffness of the suspension system and that of the pivot for each degree of freedom:

| Degree of freedom i | Suspension | Condition | Pivot |
|---|---|---|---|

The essential degree of freedom of the pivot:

| | | | |
|---|---|---|---|
| RZ | $C_{RZ}^{susp}$ | > | $N \cdot C_{RZ}^{pivot}$ |

And the five flexible degrees of freedom of the suspension system:

| | | | |
|---|---|---|---|
| X | $K_x^{susp}$ | < | $1/M \cdot K_X^{pivot}$ |
| Y | $K_Y^{susp}$ | < | $1/M \cdot K_Y^{pivot}$ |
| Z | $K_Z^{susp}$ | < | $1/M \cdot K_Z^{pivot}$ |
| RX | $C_{RX}^{susp}$ | < | $1/M \cdot C_{RX}^{pivot}$ |
| RY | $C_{RY}^{susp}$ | < | $1/M \cdot C_{RY}^{pivot}$ |

Value N is preferably chosen to be higher than or equal to 10, and in particular higher than or equal to 100 or to 1000.

Value M is preferably chosen to be higher than or equal to 10, and in particular higher than or equal 50.

Thus, in first rotational degree of rotation RZ, flexible suspension system 300 is at least N times, in particular 10 times, stiffer than flexure pivot 200 in first rotational degree of freedom RZ.

Further, in the first translational degree of rotation, second translational degree of rotation, third translational degree of rotation, second rotational degree of freedom RX and third rotational degree of freedom RY, flexible suspension system 300 is at least M times, in particular 10 times, less stiff than flexure pivot 200 in said first translational degree of freedom, said second translational degree of freedom, said third translational degree of freedom, said second rotational degree of freedom RX and said third rotational degree of freedom RY.

Consequently, in the first translational degree of freedom, second translational degree of freedom, third translational degree of freedom, second rotational degree of freedom RX and third rotational degree of freedom RY, flexible suspension system 300 is at least N·M times, in particular 100 times, less stiff than it is in first rotational degree of freedom RZ.

More particularly, in first rotational degree of rotation RZ, flexible suspension system 300 is at least 100 times stiffer than flexure pivot 200 in first rotational degree of freedom RZ. In other words, the stiffness in the stiffest degree of freedom of the suspension system is at least 100 times greater than the stiffness of the flexure pivot of the resonator.

More particularly still, in first rotational degree of rotation RZ, flexible suspension system 300 is at least 1000 times stiffer than flexure pivot 200 in first rotational degree of freedom RZ.

More particularly, in the first translational degree of rotation, second translational degree of rotation, third translational degree of rotation, second rotational degree of freedom RX and third rotational degree of freedom RY, flexible suspension system 300 is at least 50 times less stiff than flexure pivot 200 in said first translational degree of freedom, said second translational degree of freedom, said third translational degree of freedom, said second rotational degree of freedom RX and said third rotational degree of freedom RY.

The stiffness of each of the 5 flexible degrees of freedom can be calculated using the relation:

$$Ki=fs*mi*ari/xi$$

where:

fs is a safety factor less than 1;

mi is the mass or inertia for the degree of freedom i;

ari is the acceleration in the degree of freedom i, which would cause breakage of the flexure pivot, in 'direction' i;

xi is the distance between the stop and said bearing surface of the resonator, in other words, the travel of the resonator in degree of freedom i up to the stop.

In a variant, flexible suspension system 300 includes a first elastic connection, which is arranged to allow it mobility in the first translational degree of freedom in first direction Z, and/or a second elastic connection arranged to allow it mobility in the second translational degree of freedom in second direction X, and/or a third elastic connection to allows it mobility in the third translational degree of freedom in third direction Y, and/or a fourth elastic connection to allow it mobility in rotation in second rotational degree of freedom RX, and/or a fifth elastic connection arranged to allow it rotational mobility in third rotational degree of freedom RY.

Advantageously, the axial stop means are also arranged to abuttingly engage with inertia element 2 in order to protect first strips 3 in second direction X, in third direction Y, in second rotational degree of freedom RX and in third rotational degree of freedom RY. These axial stop means include first radial bearing surfaces 79, 89, which are arranged to cooperate with complementary first bearing surfaces 279, 289, comprised in inertia element 2, and second bearing surfaces 78, 88, which are arranged to cooperate with complementary second bearing surfaces 278, 288, comprised in inertia element 2. More particularly, these stop means are carried by structure 1. The teaching of Swiss Patent Application No CH713137 in the name of Swatch Group Research & Development Ltd can be used for the present invention.

Figure 3:
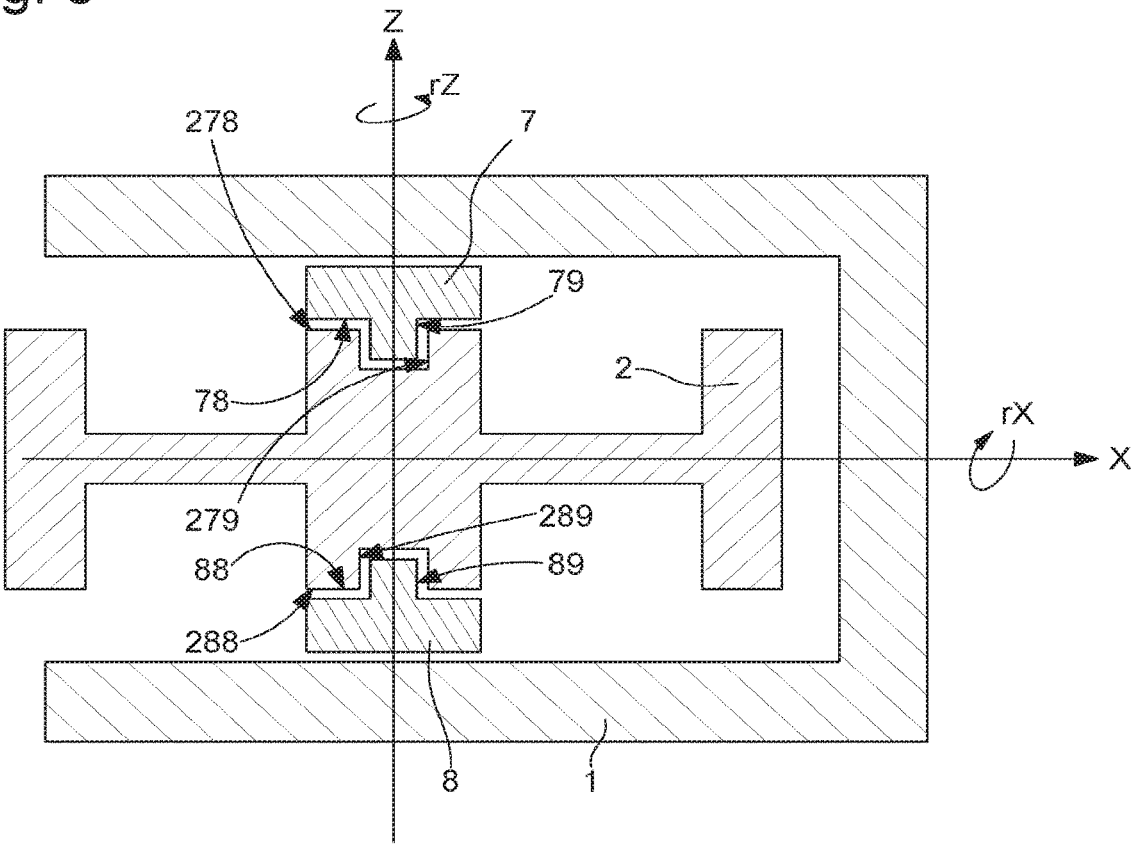
FIG. 3 represents a schematic, sectional view through the pivot axis of the inertia weight, the system of anti shock stops of the invention, on either side of the inertia weight and borne by a fixed structure.
Figure 6:
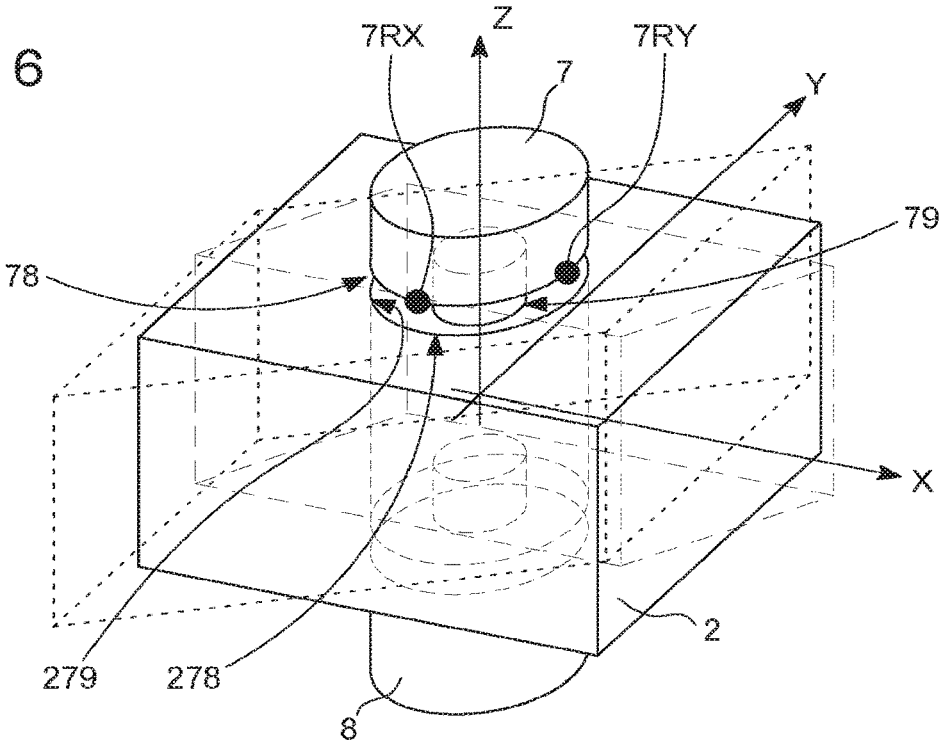
FIG. 6 represents a schematic, perspective view of the inertia weight between the stops and examples of banking in extreme angular positions in the rotational degrees of freedom RX and RY.

As seen in FIGS. 3 and 6, in a variant, the stop means include a first axial stop 7 and a second axial stop 8, which are stepped cylinders, arranged on either side of inertia element 2 along the axis of oscillation of the resonator parallel to first direction Z. Complementary first bearing surfaces 278, 289 are bores here of inertia element 2, which extend in first direction Z, on both sides of inertia element 2. Second bearing surfaces 78, 88 are substantially flat and arranged to cooperate with an edge of one of the stepped cylinders during movement in degree of freedom RX or RY. FIG. 6 illustrates, in a dot and dash line, two angular stop configurations at RX and RY, respectively through contacts at points 7RX and 7RY between first stop 7 and inertia element 2.

Advantageously, the flexibility of the elastic means of the flexible suspension system in the five flexible degrees of freedom of the suspension system, is such that the frequencies of the natural vibration modes of the flexible suspension system in these five degrees of freedom are at least 10 times higher than the main oscillation frequency of the resonator during oscillation of inertia weight 2. More particularly, they are at least 50 times higher than the main oscillation frequency of the resonator during oscillation of inertia weight 2. Advantageously, this main oscillation frequency of the resonator is high, higher than 10 Hz, especially close to 20 Hz.

It is understood that numerous alternative arrangements are possible for bending and/or twisting some of these elastic connections, particularly by decoupling or coupling the degrees of freedom, which can result in five different elastic connections, and four intermediate weights between structure 1 and anchor unit 30. However, to save space which is always scarce inside a watch, it is advantageous to couple several degrees of freedom on certain connections.

Figure 4:
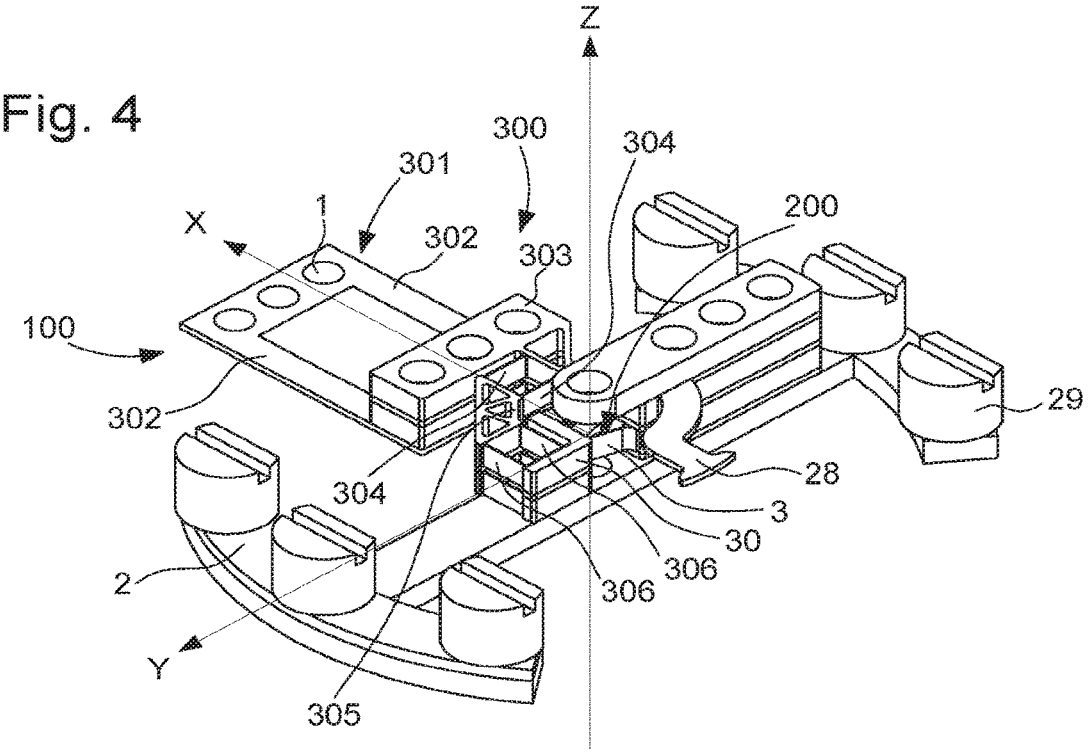
FIG. 4 represents a schematic, perspective view of a resonator mechanism according to the invention, comprising a suspension system flexible in 5 degrees of freedom but stiff in the only degree of freedom in which said pivot works, wherein its flexible connections at X and Y are each provided by two parallel flexible strips; the stop system of FIG. 3 is not represented.
Figure 5:
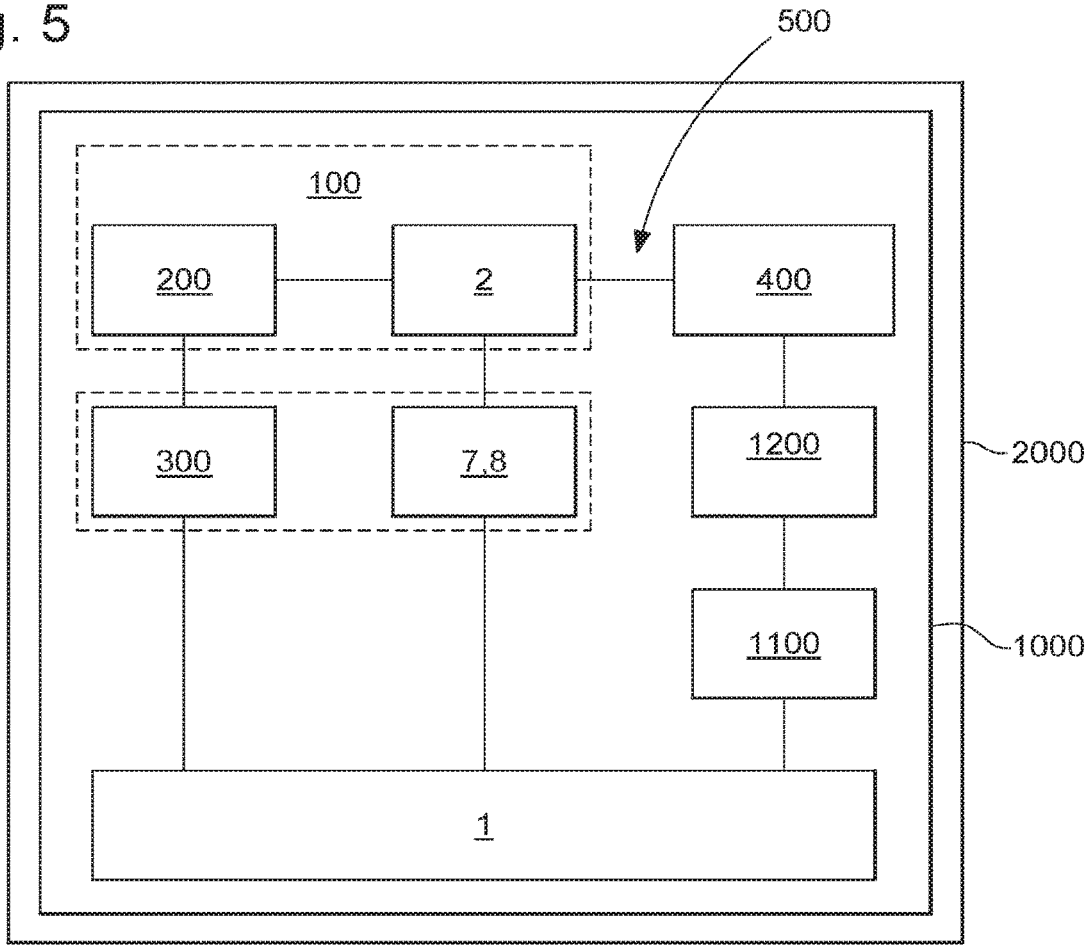
FIG. 5 is a block diagram representing a watch including a movement with an oscillator which in turn includes a resonator mechanism according to the invention.
Figure 7:
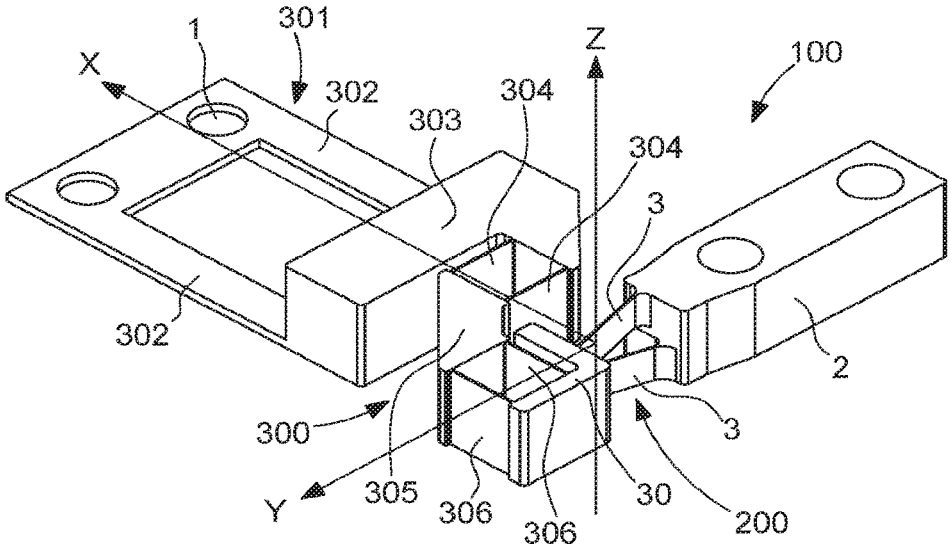
FIG. 7 is a detail of FIG. 4 comprising only the flexure pivot and the flexible suspension system, in a particular, one-piece version.
Figure 9:
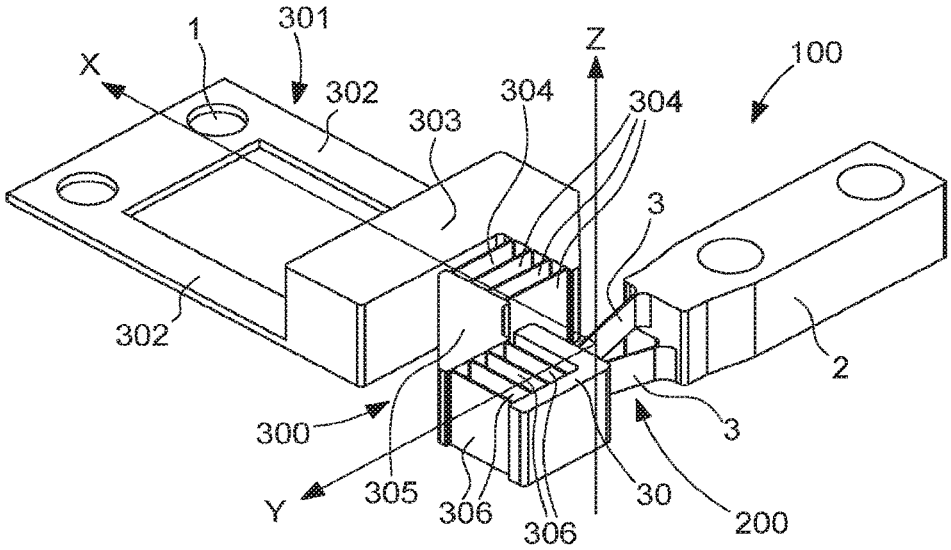
FIG. 9 illustrates a variant of FIG. 7, where the flexible connections at X and Y are provided by more than two parallel flexure strips.

In a variant, a plate, which includes at least two parallel and coplanar flexible strips, provides the first elastic connection with mobility in the first translational degree of freedom in first direction Z, the fourth elastic connection with rotational mobility in second rotational degree of freedom RX, and the fifth elastic connection with rotational mobility in the third rotational degree of freedom RY: it controls flexibility in degrees of freedom Z, RX and RY. FIGS. 4, 7 and 9 illustrate such a plate 301 with its two flexible strips 302.

In another variant, mobility in the second translational degree of freedom in second direction X is provided by a set of flexible strips comprising at least two parallel and non coplanar flexible strips, and/or mobility in the third translational degree of freedom in third direction Y is provided by a set of flexible strips comprising at least two parallel and non coplanar flexible strips.

In yet another variant, mobility in the second translational degree of freedom in second direction X and in second rotational degree of freedom RX, is provided by a single flexible strip essentially deformable in a plane XY perpendicular to first direction Z and arranged to withstand a twist of +/−10° with respect to its longitudinal direction.

In a similar manner in another variant, mobility in the third translational degree of freedom in third direction Y and in third rotational degree of freedom RY, is provided by a single flexible strip essentially deformable in a plane XY perpendicular to first direction Z and arranged to withstand twisting by +/−10° with respect to its longitudinal direction.

Naturally, a lower number of elastic connections can be employed, if conditions as to the inequalities to be respected between stiffnesses are satisfied.

Figure 8:
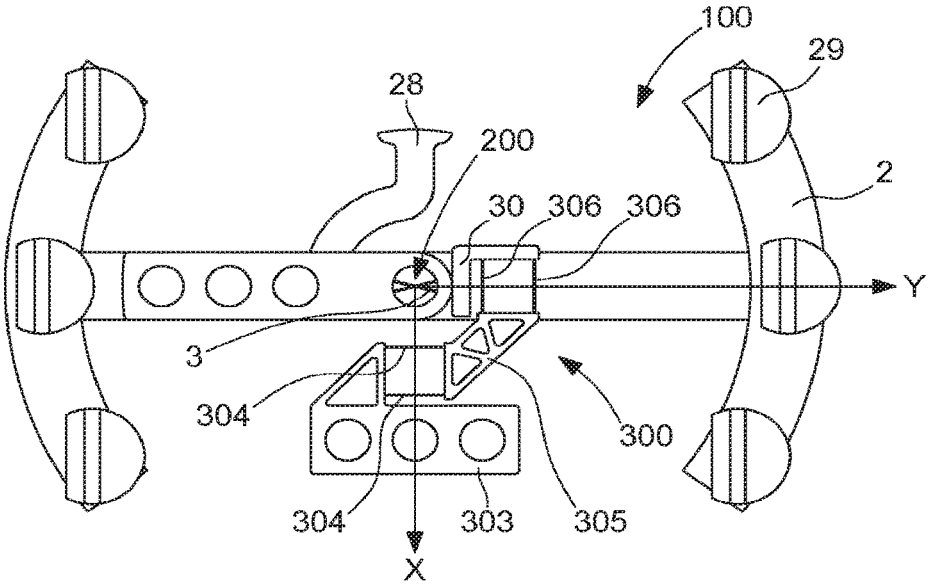
FIG. 8 is a partial top view of the resonator of FIG. 4.

FIGS. 4, 7 and 8 illustrate a particular non-limiting embodiment, wherein a plate 301, comprising two parallel, coplanar strips 302, is fixed to structure 1 and allows a first intermediate weight 303 mobility in direction Z. The latter carries two non-coplanar parallel flexible strips 304 providing mobility in direction X to a second intermediate weight 305, which carries, via two non-coplanar parallel flexure strips 306, anchor unit 30, allowing it mobility in direction Y. Mobility along RX and RY is limited and allowed only by the low possible twisting of strips 302, 304 and 306.

More particularly, elastic strips 3 of elastic pivot 200 are straight and the directions in which elastic strips 3 extend, in projection onto a plane perpendicular to this pivot axis D, intersect at pivot axis D. More particularly, these elastic strips are arranged according to the teaching of Swiss Patent Application Nos. CH712068 in the name of ETA Manufacture Horlogère Suisse and CH710524 in the name of Swatch Group Research & Development Ltd.

More particularly, the pivot is of the type having a large angular travel, in accordance with Swiss Patent Application No. CH00980/17 in the name of Swatch Group Research & Development Ltd.

In a non-illustrated variant, the mechanical interaction between the axial stop means and surfaces of inertia element 2 is supplemented by magnetic interaction between these axial stop means and these surfaces.

More particularly, inertia element 2 includes at least one inertia block 29 which is adjustable in position and/or orientation to adjust the position setting of its centre of mass and of its inertia.

Advantageously, mass MA of anchor unit 30, like the mass of every intermediate unit, such as first intermediate weight 303 or second intermediate weight mass 305, which is placed in the flexible suspension system between anchor unit 30 and structure 1, is less than a tenth of mass M0 of inertia element 2.

The invention also concerns a timepiece oscillator mechanism 500 including such a timepiece resonator mechanism 100 and an escapement mechanism 400, arranged to cooperate with one another. Inertial element 2 includes here a pin 28 for this purpose.

The invention also concerns a timepiece movement 1000 including at least one such oscillator mechanism 500, and/or at least one such resonator mechanism 100. This movement 1000 carries, on structure 1, an energy source 1100 such as a barrel, powering a train 1200 providing the display and coupled to escapement mechanism 400.

In a variant, this movement is provided with a Swiss lever escapement.

In another variant, this movement is provided with a frictional rest escapement.

In yet another variant, this movement is provided with a magnetic rest escapement.

FIG. 9 illustrates a variant wherein the translational guiding in direction X, as in direction Y, has more than two parallel strips, in order to increase its stiffness without increasing the maximum stress that would result from thickening the two strips of FIGS. 4, 7 and 8.

Advantageously, the flexure pivot is made of silicon and temperature compensated by a layer of silicon dioxide.

In a particular embodiment, flexible suspension system 300 and anchor unit 30 form a one-piece assembly.

In another particular embodiment, flexible suspension system 300 and flexure pivot 200 form a one-piece assembly.

Advantageously, at least one of the components of escapement mechanism 400 is made of silicon, or suchlike, to minimise its inertia, and notably is a pierced component, such as the escape wheel of FIG. 1.

Advantageously, the inertia element is an at least locally latticework structure in order to minimise its mass/inertia ratio.

The invention also concerns a watch 2000 including at least one such movement 1000, and/or at least one such timepiece oscillator 500, and/or at least one such resonator mechanism 100.

The invention makes it possible to uncouple the useful degree of freedom of the flexure pivot from the degrees of freedom of the suspension system. In this manner, the suspension system protects the pivot from breakage in the event of impact in five degrees of freedom, without affecting the stiffness of the pivot which is useful in the degree of freedom that it defines. If the degrees of freedom were not uncoupled, the suspension system would allow the point of attachment of the strips to move, which would result in a significant decrease in the resonator quality factor. If the suspension system were extremely stiff, this would result in breakage of the pivot strips in the event of accidental impacts. Thus, the invention makes it possible to protect the flexure pivot from breakage without impairing the qualities of the resonator.

The invention claimed is:

1. A timepiece resonator mechanism comprising a structure and an anchor unit to which is suspended at least one inertia element arranged to oscillate with a first rotational degree of freedom RZ about a pivot axis extending in a first direction Z, said inertia element being subjected to return forces exerted by a flexure pivot comprising a plurality of first elastic strips, each fixed at a first end to said anchor unit and at a second end to said inertia element, each said elastic strip being essentially deformable in a plane XY perpendicular to said first direction Z, said resonator mechanism including axial stop means including at least a first axial stop and/or a second axial stop to limit the translational travel of said inertia element at least in said first direction Z, said axial stop means being arranged to abuttingly engage with said inertia element in order to protect said first strips at least against axial impacts in said first direction Z, wherein said anchor unit is suspended to said structure by a flexible suspension system arranged to allow said anchor unit mobility in five flexible degrees of freedom of the suspension system, which are a first translational degree of freedom in said first direction Z, a second translational degree of freedom in a second direction X orthogonal to said first direction Z, a third translational degree of freedom in a third direction Y orthogonal to said second direction X and to said first direction Z, a second rotational degree of freedom RX about an axis extending in said second direction X, and a third rotational degree of freedom RY about an axis extending in said third direction Y, wherein, in said first rotational degree of freedom RZ, said flexible suspension system is at least 10 times less stiff than said flexible pivot in said first rotational degree of freedom RZ, and also wherein, in said first translational degree of freedom, said second translational degree of freedom, said third translational degree of freedom, said second rotational degree of freedom RX, said third rotational degree of freedom RY, said flexible suspension system is at least 10 times stiffer than said flexible pivot respectively in said first translational degree of freedom, said second translational degree of freedom, said third translational degree of freedom, said second rotational degree of freedom RX and said third rotational degree of freedom RY.

2. The resonator mechanism according to claim 1, wherein, in said first rotational degree of rotation RZ, said flexible suspension system is at least 100 times stiffer than said flexure pivot in said first rotational degree of freedom RZ.

3. The resonator mechanism according to claim 2, wherein, in said first rotational degree of rotation RZ, said flexible suspension system is at least 1000 times stiffer than said flexure pivot in said first rotational degree of freedom RZ.

4. The resonator mechanism according to claim 1, wherein, in said first translational degree of freedom, said second translational degree of freedom, said third translational degree of freedom, said second rotational degree of freedom RX, said third rotational degree of freedom RY, said flexible suspension system is at least 50 times less stiff than said flexible pivot respectively in said first translational degree of freedom, said second translational degree of freedom, said third translational degree of freedom, said second rotational degree of freedom RX and said third rotational degree of freedom RY.

5. The resonator mechanism according to claim 1, wherein said flexible suspension system includes comprises a first elastic connection arranged to allow said suspension system mobility in said first translational degree of freedom in said first direction Z, and/or a second elastic connection arranged to allow said suspension system mobility in said second translational degree of freedom in said second direction X, and/or a third elastic connection arranged to allow said suspension system mobility in said third translational degree of freedom in said third direction Y, and/or a fourth elastic connection to allow said suspension system rotational mobility in said second rotational degree of freedom RX, and/or a fifth elastic connection arranged to allow said suspension system rotational mobility in said third rotational degree of freedom RY.

6. The resonator mechanism according to claim 5, wherein a plate including at least two parallel and coplanar flexible strips provides said first elastic connection with mobility in said first translational degree of freedom in said first direction Z, said fourth elastic connection with rotational mobility in said second rotational degree of freedom RX and said fifth elastic connection with rotational mobility in said third rotational degree of freedom RY.

7. The resonator mechanism according to claim 5, wherein mobility in said second translational degree of freedom in said second direction X is provided by a set of flexible strips comprising at least two parallel and non coplanar flexible strips, and/or in that mobility in said third translational degree of freedom in said third direction Y is provided by a set of flexible strips comprising at least two parallel and non coplanar flexible strips.

8. The resonator mechanism according to claim 5, characterized in that mobility in said second translational degree of freedom in said second direction X, and wherein second rotational degree of freedom RX, is provided by a single flexible strip essentially deformable in a plane XY perpendicular to said first direction Z and arranged to withstand a twist of +/−10° with respect to its longitudinal direction.

9. The resonator mechanism according to claim 5, wherein mobility in said third translational degree of freedom in said third direction Y, and wherein third rotational degree of freedom RY, is provided by a single flexible strip essentially deformable in a plane XY perpendicular to said first direction Z and arranged to withstand a twist of +/−10° with respect to its longitudinal direction.

10. The resonator mechanism according to claim 1, wherein said axial stop means are further arranged to abuttingly engage with said inertia element in order to protect said first strips in said second direction X, in said third direction Y, in said second rotational degree of freedom RX, and in said third rotational degree of freedom RY, and include first radial bearing surfaces arranged to cooperate with complementary first bearing surfaces, comprised in said inertia element, and second bearing surfaces arranged to cooperate with complementary second bearing surfaces comprised in said inertia element.

11. The resonator mechanism according to claim 10, wherein said stop means include a first said axial stop and a second said axial stop, which are stepped cylinders, arranged on either side of said inertia element along the axis of oscillation of the resonator parallel to said first direction Z, and wherein said complementary first bearing surfaces are bores of said inertia element which extend in said first direction Z, and wherein said second bearing surfaces are substantially flat and arranged to cooperate with an edge of one of said stepped cylinders.

12. The resonator mechanism according to claim 1, wherein said stop means are carried by said structure.

13. The resonator mechanism according to claim 12, wherein said stop means include a first said axial stop and a second said axial stop, which are stepped cylinders, arranged on either side of said inertia element along the axis of oscillation of the resonator parallel to said first direction Z, and wherein said complementary first bearing surfaces are bores of said inertia element which extend in said first direction Z, and wherein said second bearing surfaces are substantially flat and arranged to cooperate with an edge of one of said stepped cylinders.

14. The resonator mechanism according to claim 1, wherein the flexibility of elastic means comprised in said flexible suspension system, in said five flexible degrees of freedom of the suspension system, is such that the frequencies of the natural vibration modes of said flexible suspension system in these five degrees of freedom are at least 10 times higher than the main oscillation frequency of the resonator during oscillation of said inertia weight.

15. The resonator mechanism according to claim 1, wherein said elastic strips are straight, and wherein the directions in which said elastic strips extend, in projection onto a plane perpendicular to said pivot axis, intersect at said pivot axis.

16. The resonator mechanism according to claim 1, wherein the mechanical interaction between said axial stop means and surfaces of said at least one inertia element is supplemented by magnetic interaction between said axial stop means and said surfaces of said at least one inertia element.

17. The resonator mechanism according to claim 1, wherein said inertia element includes at least one inertia block adjustable in position and/or orientation in order to adjust the position of the centre of inertia thereof.

18. The resonator mechanism according to claim 1, wherein the mass MA of said anchor unit, like the mass of any intermediate unit placed in said flexible suspension system between said anchor unit and said structure, is less than one tenth of the mass M0 of said inertia element.

19. A timepiece oscillator mechanism comprising a timepiece resonator mechanism according to claim 1 and an escapement mechanism, arranged to cooperate with one another.

20. The timepiece movement comprising at least one oscillator mechanism according to claim 19.

21. A watch comprising at least one movement according to claim 20.

22. The timepiece movement comprising at least one resonator mechanism according to claim 1.

* * * * *